US008833258B2

(12) United States Patent
Vest et al.

(10) Patent No.: US 8,833,258 B2
(45) Date of Patent: Sep. 16, 2014

(54) MEANS FOR ATTACHING A PRINTING PLATE TO A PRINTING CYLINDER

(76) Inventors: Ryan W Vest, Cumming, GA (US); Deborah Johnson, Powder Springs, GA (US)

( * ) Notice: Subject to any disclaimer, the term of this patent is extended or adjusted under 35 U.S.C. 154(b) by 1158 days.

(21) Appl. No.: 12/367,650

(22) Filed: Feb. 9, 2009

(65) Prior Publication Data

US 2010/0199871 A1 Aug. 12, 2010

(51) Int. Cl.

| | |
|---|---|
| ***B41N 6/02*** | (2006.01) |
| ***B41F 27/12*** | (2006.01) |
| *B41F 27/00* | (2006.01) |

(52) U.S. Cl.

CPC ..... *B41F 27/1275* (2013.01); *B41N 6/02* (2013.01)

USPC ..... 101/483; 101/415.1

(58) Field of Classification Search

None

See application file for complete search history.

(56) References Cited

U.S. PATENT DOCUMENTS

| | | | | |
|---|---|---|---|---|
| 3,928,113 | A * | 12/1975 | Rosenberg | 156/701 |
| 4,442,302 | A | 4/1984 | Pohl | |
| 4,556,595 | A | 12/1985 | Ochi | |
| 5,141,790 | A * | 8/1992 | Calhoun et al. | 428/40.4 |
| 5,266,402 | A * | 11/1993 | Delgado et al. | 428/355 AK |
| 5,715,750 | A | 2/1998 | Goovaard | |
| 5,733,948 | A | 3/1998 | Nelson | |
| 5,919,562 | A * | 7/1999 | Root | 428/343 |
| 6,079,329 | A | 6/2000 | Goovaard et al. | |
| 6,085,653 | A | 7/2000 | Goovaard et al. | |
| 6,399,278 | B1 | 6/2002 | Leach | |
| 2001/0012599 | A1 | 8/2001 | Michels et al. | |
| 2003/0180655 | A1 | 9/2003 | Fan et al. | |
| 2004/0234886 | A1 | 11/2004 | Rudolph et al. | |
| 2005/0142480 | A1 | 6/2005 | Bode et al. | |

* cited by examiner

*Primary Examiner* — Joshua D Zimmerman

(74) *Attorney, Agent, or Firm* — Carmody Torrance Sandak & Hennessey LLP

(57) ABSTRACT

A means for removably attaching a printing plate to a printing cylinder using an intermediate sheet of photopolymer. The tack of the photopolymer is used to attach itself to the printing cylinder and to attach the printing plate to it. Microspheres are incorporated into the photopolymer sheet to provide a cushioning effect when in use on the printing press.

7 Claims, No Drawings

MEANS FOR ATTACHING A PRINTING PLATE TO A PRINTING CYLINDER

FIELD OF THE INVENTION

This invention relates to a means and device for attaching a flexographic printing plate to a printing cylinder on a printing press. The means and device disclosed allow for the printing plate to be removably attached to the printing cylinder.

BACKGROUND OF THE INVENTION

There are several known methods of attaching a printing plate to a printing cylinder. The most widely used method is the simple use of double stick tape. In this regard double stick tape is utilized to directly or indirectly attach the printing plate to the printing cylinder. A second method involves the use of a photopolymer to attach the printing plate to the printing cylinder. This method is described in U.S. Pat. No. 5,715,750, the teachings of which are incorporated herein by reference. The last method utilizes a clamp to attach the printing plate to the printing cylinder. In the case of each of the foregoing attachment methods, separate sheets of foam are frequently used to provide additional cushion or resiliency to the overall structure.

Problems in this regard occur in that using double stick tape causes difficulties in removing the tape from the printing cylinder and/or from the printing plate because the tape frequently leaves residues behind which will later interfere with the reuse of the printing plate. In addition, the use of multiple pieces of double stick tape, as is generally required, makes registration of the printing plate on the printing cylinder difficult, especially since removal and repositioning is difficult. Further, the use of multiple layers of foam backing, as is also generally required, also presents problems in registration and in efficiency of the mounting operation.

As a result, it is an object of this invention to provide a means and device which will allow the easy attachment and removal of printing plates to a printing cylinder while at the same time providing a cushioning layer as an integral part of the attaching means. Thus the invention disclosed herein resolves the drawbacks of the use of double stick tape in that it leaves no problematic residues upon detachment and can be used to easily position and re-position the printing plate on the printing cylinder for ease of registration.

SUMMARY OF THE INVENTION

The inventors herein propose a method for removably attaching a printing plate to a printing cylinder said method comprising:

(1) attaching a layer of photopolymer to the printing cylinder which layer of photopolymer comprises first and second major faces wherein the first major face attaches to the printing cylinder and wherein first and second major faces have a surface stickiness (tack) of at least 5.88 Newtons (600 g) as measured by ASTM standard D-2979-95;

(2) attaching the printing plate to the second major face;

wherein the layer of photopolymer comprises:

(a) binder;

(b) at least one monomer;

(c) photoinitiator; and (d) microspheres with a diameter of less than 90 microns.

DETAILED DESCRIPTION OF THE INVENTION

The inventors herein propose a method for attaching a printing plate to a printing cylinder such that the printing plate can easily be removed, reattached and repositioned on the printing cylinder and such that the attaching means can be reused to attach multiple printing plates to the printing cylinder over time. Further, the means for removably attaching the printing plate to the printing cylinder provides a cushioning effect for the printing plate during use.

The foregoing advantages can be accomplished by utilizing a method for removably attaching a printing plate to a printing cylinder, said method comprising:

(1) attaching a layer of a photopolymer to the printing cylinder which layer of photopolymer comprises first and second major faces which are opposed to each other wherein the first major face contacts and attaches to the printing cylinder and wherein the first and second major faces have a surface stickiness (tack) of at least 5.88 Newtons (600 g) as measured by ASTM standard D-2979-95.

(2) contacting and attaching the printing plate to the second major face;

wherein the layer of photopolymer comprises:

(a) binder;

(b) at least one monomer;

(c) photoinitiator; and (d) microspheres with a diameter of less than 90 microns.

The layer of photopolymer serves as the attachment means for attaching the printing plate to the printing cylinder. In this regard the photopolymer in sheet form is cut to size such that it can be wrapped around the cylinder, completely or partially. Thus one side or face of the photopolymer sheet is placed in contact with the exterior surface of the printing cylinder. The stickiness of the photopolymer keeps the photopolymer sheet in contact with the printing cylinder; however, the sheet of photopolymer can be easily removed by merely pulling it off the printing cylinder with enough force to overcome the adhesion. It should be noted in this regard that the printing cylinders involved generally have outer surfaces that comprise polished chrome, nickel, steel or stainless steel. As a result the sheet of photopolymer is easily and cleanly removable from the printing cylinder when desired. After the sheet of photopolymer is attached to the printing cylinder via one surface or face of the photopolymer the other surface or face of the photopolymer is available for attaching the printing plate. In this regard the back surface or substrate of the printing plate is brought into contact with the second, exposed, surface of the photopolymer such that the substrate of the printing plate detachably adheres to the photopolymer. Generally the substrate of these printing plates comprises a smooth sheet of polyethylene teraphthalate or polyethylene naphthalate. As a result, although the printing plate adheres to the photopolymer, the printing plate can be easily and cleanly removed from the photopolymer. The photopolymer sheet can be reused by attaching it to and detaching it from the printing cylinder and by attaching and detaching the printing plate from it. When the surfaces of the photopolymer become dirty, the surface tack can decrease. The surface tack of the photopolymer in this case can be re-established for re-use by cleaning the surfaces of the photopolymer with ethyl acetate or another suitable solvent.

The photopolymer sheet generally comprises (i) one or more binders, (ii) one or more monomers, (iii) one or more photoinitiators and (iv) microspheres. Suitable binders include polyurethane oligomers (i.e. "prepolymers"), based on the reaction of one or multiple diols(polyols) with an isocyanate species. Suitable polyols include poly(ethylene glycol-co-propylene glycol), poly(propylene glycol), poly (tetratmethylene glycol), poly (1,2-butylene glycol), hydrogenated polybutadiene diol, polybutadiene diol, various polyester polyols (adipic acid based, capralactone based, etc.). Most preferred are hydrogenated polybutadiene diol poly (ethylene glycol-co-propylene glycol, and poly (propylene glycol). Suitable isocyanates include toluene diisocyanate (TDI) and associated isomer mixtures, and isophorone diisocyanate (IPDI). Most preferred are mixtures of TDI and IPDI at 80/20 weight percent respectively.

The concentration of the binder in the photopolymer can range from 60 to 90 weight percent but is preferably from 75 to 85 weight percent.

Suitable monomers include alkyl(meth)acylic and acrylic esters such as, Lauryl acrylate (LMA), alkoxylated methacrylic/acrylic esters such as poly(propylene glycol monomethacrylate) (PPGMMA), hydroxylpropyl methacrylate (HPMA), dimethacrylic or acrylic esters such as polypropylene glycol dimethacrylate (PPGDMA), butylene glycol dimethacrylate (BGDMA), diethylene glycol dimethacrylate, and trifunctional acrylic esters such as trimethyol propane trimethacylate (TMPTMA) or trimethyol propane triacrylate (TMPTA). Most preferred are LMA, PPGMMA, HPMA, PPGDMA, BGDMA, and TMTPMA.

The concentration of monomers in the photopolymer can range from 5 to 20 weight percent. The type and amount of monomers used in the photopolymer will have a significant effect on the stickiness (tack) of the cured photopolymer sheet thus one primary variable in controlling the stickiness of the cured photopolymer is the amount and type of monomer used. Generally if the concentration of monomer is increased and/or the molecular weight of the monomer is decreased, the cured photopolymer will be stickier.

Suitable photoinitiators include: benzyl dimethyl ketal (IRGACURE® 651), benzoin isobutyl ether (BIBE), benzophenone and associated derivatives, 2,2-diethoxyacetophenone, cyclohexyl phenyl ketone and such derivatives (IRGACURE® 184), etc. mono and di-acylphosphine oxide derivatives (IRGACURE® 819).

The most preferred photoinitiators are BIBE, IRGACURE® 184, and IRGACURE® 651. Most preferred is BIBE. The concentration can range from 0.5 to 3 weight percent but is preferably from 1 weight percent to 2 weight percent.

The choice of microspheres is important to the success of this invention. The microspheres are preferably of uniform size or uniform particle size distribution and can exist as either expanded or unexpanded particles. In a preferred embodiment, expanded microspheres are used, due to the heat required to effectively mix the microspheres into the viscous resin composition. The weight percent of the microspheres in the composition typically ranges from about 0.5% to about 5.0% by weight of the resin formulation, but is preferably from about 1.0% to 2.5% by weight. Obviously the type, size and amount of microspheres used in the photopolymer will control the cushioning effect achievable and the resilience of the photopolymer. These must be optimized for the particular print application being employed.

Regardless of whether the microspheres are expanded or unexpanded, the microspheres generally consist of a thermoplastic shell encapsulating a hydrocarbon. The shell of the microsphere is typically a copolymer of acrylonitrile and vinylidene chloride or methacrylonitrile, and the hydrocarbon inside the shell is typically isobutene or isopentane. There are a number of commercial sources for thermoplastic microspheres. EXPANCEL® is a trade name for microspheres available from Noble Industries. DUALITE® and MICROPEARL® polmeric microspheres are available from Pierce & Stevens Corporation.

In order to form the photopolymer sheet the components of the photopolymer are mixed together and then the mixed photopolymer is either cast or extruded into a sheet of the thickness required. The photopolymer sheet is then cured by exposing it to ultraviolet radiation. The amount of radiation necessary varies based upon the composition and thickness of the photopolymer. The amount of radiation used, and therefore the extent of the curing of the photopolymer is another variable that may be used to control the stickiness (tack) of the photopolymer. Generally, the less cured the photopolymer is, the stickier it will be. However, the photopolymer must be cured enough so that the integrity and strength of the photopolymer are sufficient. Once the photopolymer sheet is cured, it is ready to be cut to size and used. Although multiple sheets of photopolymer can be stacked onto each other on the printing cylinder, it is preferable to apply one sheet of photopolymer with the desired thickness.

The surface stickiness or tack of the photopolymer sheet can be measured after curing using ASTM method ASTM D-2979-95. The surface stickiness (tack) of the photopolymer should be at least 600 g and is preferably from 6.86 to 14.7 Newtons (700 g). The resilience of the photopolymer after curing can be measured by ASTM method D2632-88 (Modified to measure at 0.250 inch thickness) and is preferably from 8 to 20. The softness of the photopolymer after curing can be measured by ASTM method D2240 can be over a wide range depending upon the printing application but is preferably from 35 to 50.

The invention claimed is:

1. A method for removably attaching a printing plate to a printing cylinder, said method comprising:

(i) attaching a photopolymer sheet to the printing cylinder which photopolymer sheet comprises first and second major faces which are opposed to each other wherein the first major face contacts and attaches to the printing cylinder and wherein the first and second major faces have a surface tack of at least 5.88 Newtons as measured by ASTM standard D-2979-95;

(ii) contacting and attaching the printing plate to the second major face;

wherein the photopolymer sheet comprises:

(a) a binder;

(b) at least one monomer;

(c) a photoinitiator; and (d) microspheres with a diameter of less than 90 microns, and wherein said photopolymer sheet is partially cured by :exposing the sheet to ultraviolet radiation to control the surface tack of the photopolymer sheet to a level of at least 5.88 Newtons as measured by ASTM standard D-2979.

2. A method according to claim 1 wherein the resilience of the photopolymer sheet is from 8 to 20 and the softness of the photopolymer sheet is from 35 to 50.

3. A method according to claim 1 wherein the surface tack is from 6.86 to 14.7 Newtons.

4. A method according to claim 1, wherein the photopolymer sheet at least substantially covers the printing cylinder.

5. A method according to claim 1, comprising the step of re-establishing the surface tack of the photopolymer sheet by cleaning the photopolymer sheet with a solvent.

6. A method according to claim 5, wherein the solvent is ethyl acetate.

7. A method according to claim 1, wherein the microspheres comprise expanded microspheres consisting of a thermoplastic shell encapsulating a hydrocarbon.

* * * * *